US005657894A

United States Patent [19]

Bowen

[11] Patent Number: 5,657,894

[45] Date of Patent: Aug. 19, 1997

[54] CLOSURE DEVICE FOR A CONTAINER

[76] Inventor: Larry J. Bowen, Rte. 1 Box 76, Fayette, Ala. 35555

[21] Appl. No.: 539,752

[22] Filed: Oct. 5, 1995

[51] Int. Cl.[6] ..... B65D 43/08; B65D 43/16; B65D 51/04; B65D 51/18

[52] U.S. Cl. ..... 220/339; 220/254; 220/780; 220/793

[58] Field of Search ..... 220/339, 337, 220/700, 306, 307, 352, 355, 356, 253, 254, 259, 780, 784, 793, 334; 215/235, 305

[56] References Cited

U.S. PATENT DOCUMENTS

| | | |
|---|---|---|
| D. 222,006 | 9/1971 | Pennell . |
| D. 239,818 | 5/1976 | Vatne . |
| D. 246,828 | 1/1978 | White . |
| D. 318,015 | 7/1991 | DeCoster et al. . |
| D. 348,834 | 7/1994 | Wardell, Jr. . |
| D. 350,688 | 9/1994 | Wardell, Jr. . |
| 3,082,926 | 3/1963 | Powell . |
| 3,186,574 | 6/1965 | Davidson . |
| 3,385,422 | 5/1968 | Lowry . |
| 4,359,169 | 11/1982 | Helms et al. . |
| 4,371,095 | 2/1983 | Montgomery et al. . |
| 4,414,705 | 11/1983 | Ostrowsky . |
| 4,433,808 | 2/1984 | Gordon et al. . |
| 4,441,625 | 4/1984 | Anderson ..... 220/257 |
| 4,453,666 | 6/1984 | Gordon . |
| 4,711,363 | 12/1987 | Marino . |
| 4,724,978 | 2/1988 | Cleevely et al. . |
| 4,724,979 | 2/1988 | Cleevely et al. . |
| 4,858,793 | 8/1989 | Stone . |
| 5,050,763 | 9/1991 | Christensson . |
| 5,085,331 | 2/1992 | Groya et al. . |
| 5,110,004 | 5/1992 | Albanesi et al. . |
| 5,145,088 | 9/1992 | Goujon . |
| 5,339,993 | 8/1994 | Groya et al. . |
| 5,402,904 | 4/1995 | Close . |
| 5,413,238 | 5/1995 | Mock . |

*Primary Examiner*—Allan N. Shoap
*Assistant Examiner*—Niki M. Kopsidas
*Attorney, Agent, or Firm*—Nies, Kurz, Bergert & Tamburro

[57] ABSTRACT

A closure device allows a welding rod container to be reclosed in an air and moisture tight manner after being opened. The device includes a frame member having an opening therein, and flanges extending downwardly from the frame member outer edges for secure attachment to the container. The opening is of sufficient size to allow a human hand to retrieve a welding rod from the open welding rod container while also helping to prevent contact of the hand with the dangerous sharp edges of the open container. A latchable lid member capable of fitting within the frame member and covering the opening therein is hingedly connected to the frame member such as by an internal or live hinge. The lid member is provided with a flanged bead extending along its outer edges capable of mating with a groove extending along the inner walls of the frame member. When the device is closed, the groove and bead mate thereby helping to form an airtight seal between the lid and frame member for protection of the welding rods from the atmosphere.

10 Claims, 3 Drawing Sheets

FIG. 4
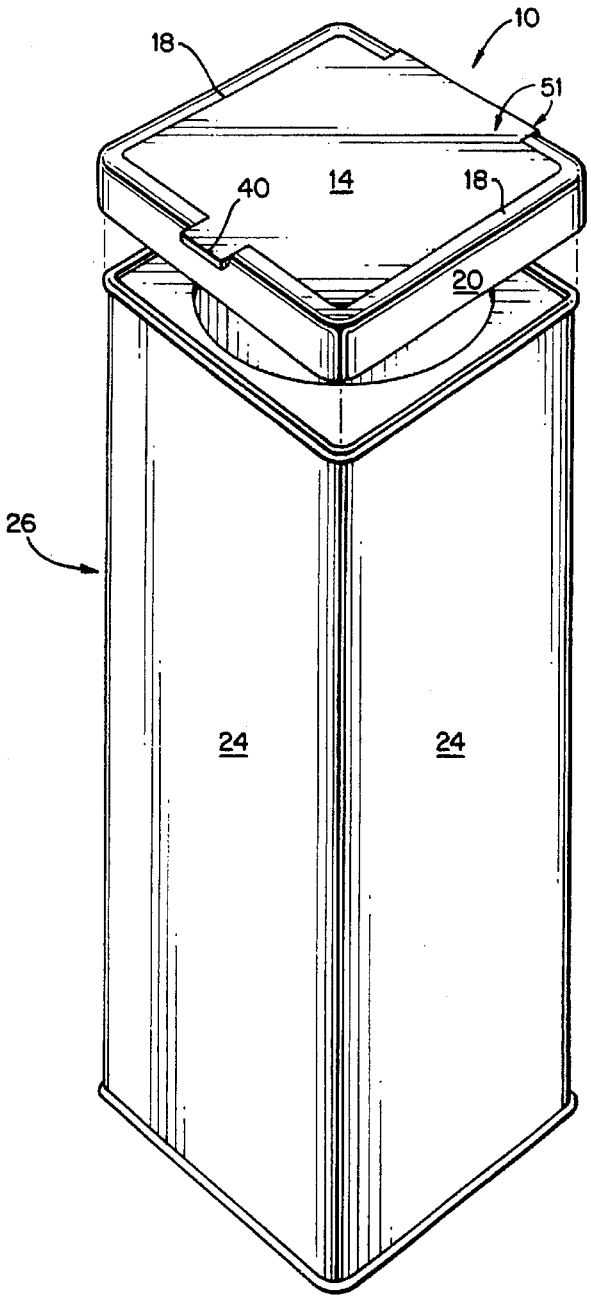
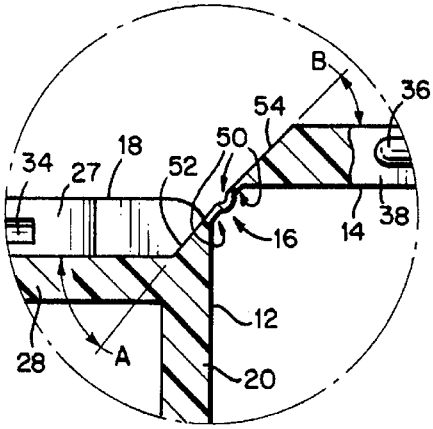
FIG. 5
FIG. 6
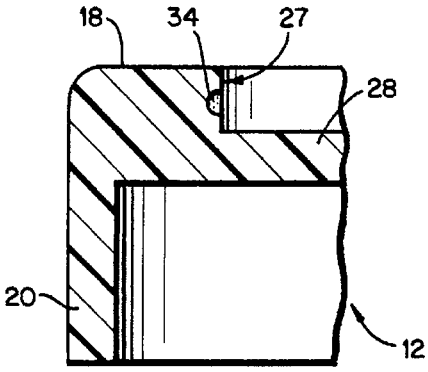
FIG. 7
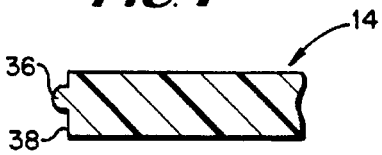

CLOSURE DEVICE FOR A CONTAINER

BACKGROUND AND SUMMARY OF THE INVENTION

This invention relates to protective caps for containers and more particularly to protective caps and closures for welding rod cases.

In the packaging and dispensing of welding rods, it is desirable to avoid exposing the rods to air, as extended exposure to air causes the rods to oxidize. For this reason, new containers of rods are packaged and sealed in air tight condition. However, once a container of welding rods is opened, the rods must be used quickly or risk harmful exposure to the air. Thus, there is a need for a device which would allow a previously opened welding rod case to be reclosed so as to prevent the oxidation of the welding rods contained therein.

Protective caps for various containers have been described in the following U.S. Pat. No. 3,082,926 to Powell; U.S. Pat. No. 3,186,574 to Davidson; U.S. Pat. No. 3,385,422 to Lowry; U.S. Pat. No. 4,359,169 to Helms et al.; U.S. Pat. No. 4,371,095 to Montgomery et al.; U.S. Pat. No. 4,414,705 to Ostrowsky; U.S. Pat. No. 4,433,808 to Gordon et al.; U.S. Pat. No. 4,453,666 to Gordon; U.S. Pat. No. 4,711,363 to Marino; U.S. Pat. No. 4,724,978 to Cleevely et al.; U.S. Pat. No. 4,724,979 to Cleevely et al.; U.S. Pat. No. 4,858,793 to Stone; U.S. Pat. No. 5,050,763 to Christensson; U.S. Pat. No. 5,085,331 to Groya et al.; U.S. Pat. No. 5,110,004 to Albanesi et al.; U.S. Pat. No. 5,145,088 to Goujon; U.S. Pat. No. 5,339,993 to Groya et al.; U.S. Pat. No. 5,402,904 to Close; and U.S. Pat. No. 5,413,238 to Mock. While these patents describe caps for closure and protection of various containers, nothing in the prior art discloses the unique and inventive features of the present invention.

It is thus one object of the present invention to provide a cap for a welding rod container which allows a previously opened welding rod container to be resealed so as to prevent oxidation of any welding rods contained therein.

It is another object of the present invention to provide a cap for a welding rod container which helps prevent hand and arm exposure to the normally sharp edges of an open welding rod container.

By the present invention, there is provided a closure device which allows a welding rod container to be reclosed in an air and moisture tight manner after being opened. The device includes a generally rectangular frame member having an opening therein, and flanges extending downwardly from the frame member outer edges for secure attachment to the container. The opening is of sufficient size to allow a human hand to retrieve a welding rod from the open welding rod container while also helping to prevent contact of the hand with the dangerous sharp edges of the open container. A latchable lid member capable of fitting within the frame member and covering the opening therein is hingedly connected to the frame member such as by an internal or live hinge. The lid member is provided with a flanged bead extending along its outer edges capable of mating with a groove extending along the inner walls of the frame member. When the device is closed, the groove and bead mate, thereby helping to form an airtight seal between the lid and frame member for protection of the welding rods from the atmosphere.

BRIEF DESCRIPTION OF THE DRAWINGS

FIG. 4 is a perspective view of the closure device shown in the closed position above a welding rod container.

FIG. 5 is an enlarged view of the hinge member shown in detail 5 in FIG. 3.

FIG. 6 is a fragmentary cross-sectional view of the frame member of the device taken along line 6—6 of FIG. 2.

FIG. 7 is a fragmentary cross-sectional view of the lid member of the device taken along line 7—7 of FIG. 2.

DESCRIPTION OF THE PREFERRED EMBODIMENTS

Figure 1:
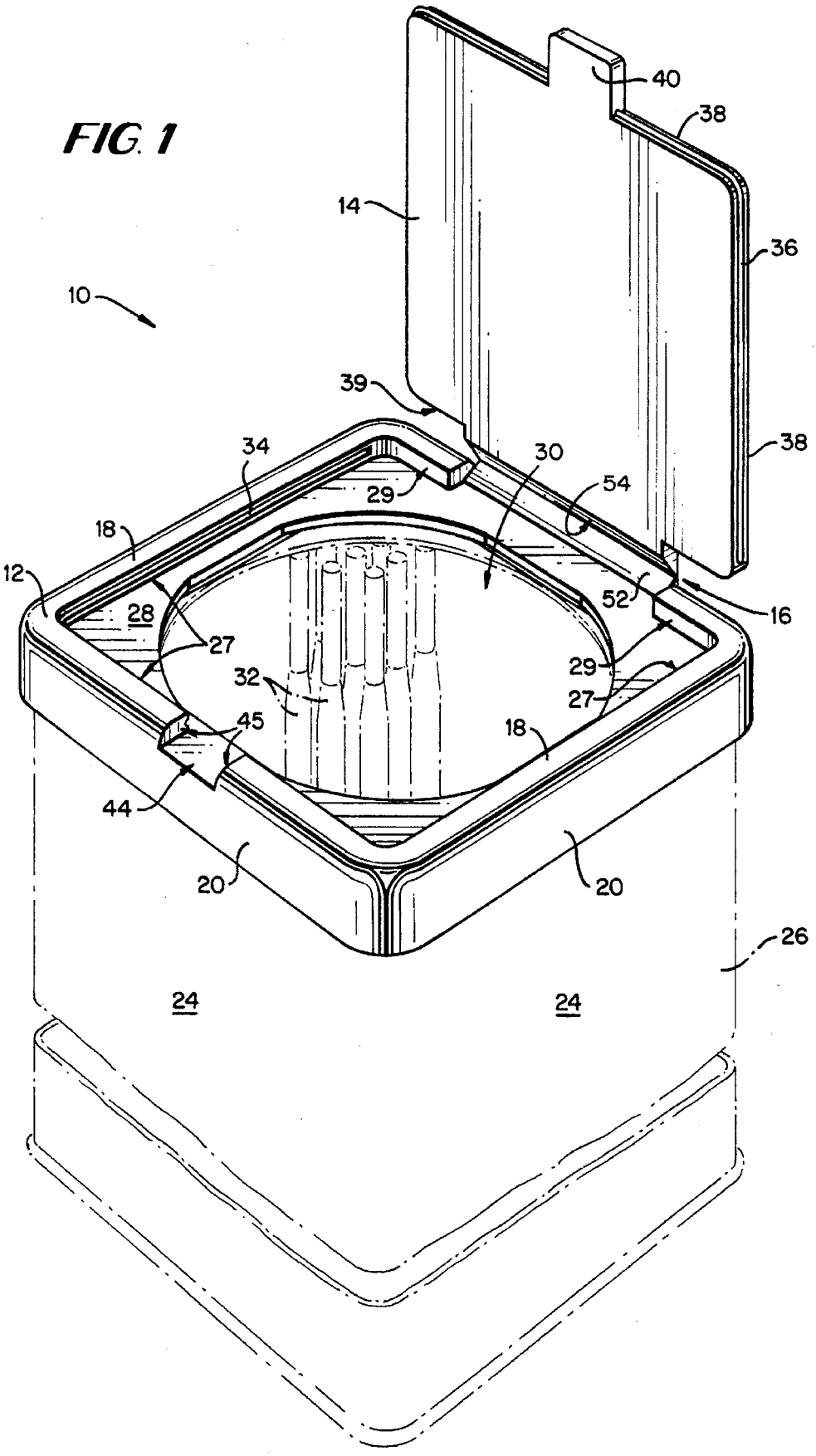
FIG. 1 is a perspective view of the device of the present invention shown in an open position.

In the embodiment of the invention as shown in FIGS. 1 through 7, there is provided a closure device 10 for a welding rod container or the like. The device may be made of polypropylene or a similar material and is provided with generally rectangular frame 12 and lid 14 members. The lid member 14 is secured to the frame member 12 at one end by an integrally molded hinge member 16.

Flanges 20 extending downwardly from the edges 18 of the frame member 12 allow the device 10 to maintain a proper seal around the outside walls 24 of a welding rod container 26, as shown in FIGS. 1 and 4. The container 26 may be any conventional welding rod container such as, for example, a 45 pound capacity or 50 pound capacity welding rod container commercially available from Crawford Container Co., Conneaut, Ohio. A recessed platform 28 extends from the inner walls 27, 29 of the frame member 12 and has an opening 30 therein large enough to permit a human hand to enter and remove a welding rod 32 from the container 26. The platform 28 extends far enough from the frame inner side 27 and inner back 29 walls to prevent potentially injurious contact of the hand with an open edge of the welding rod container 26.

Figure 2:
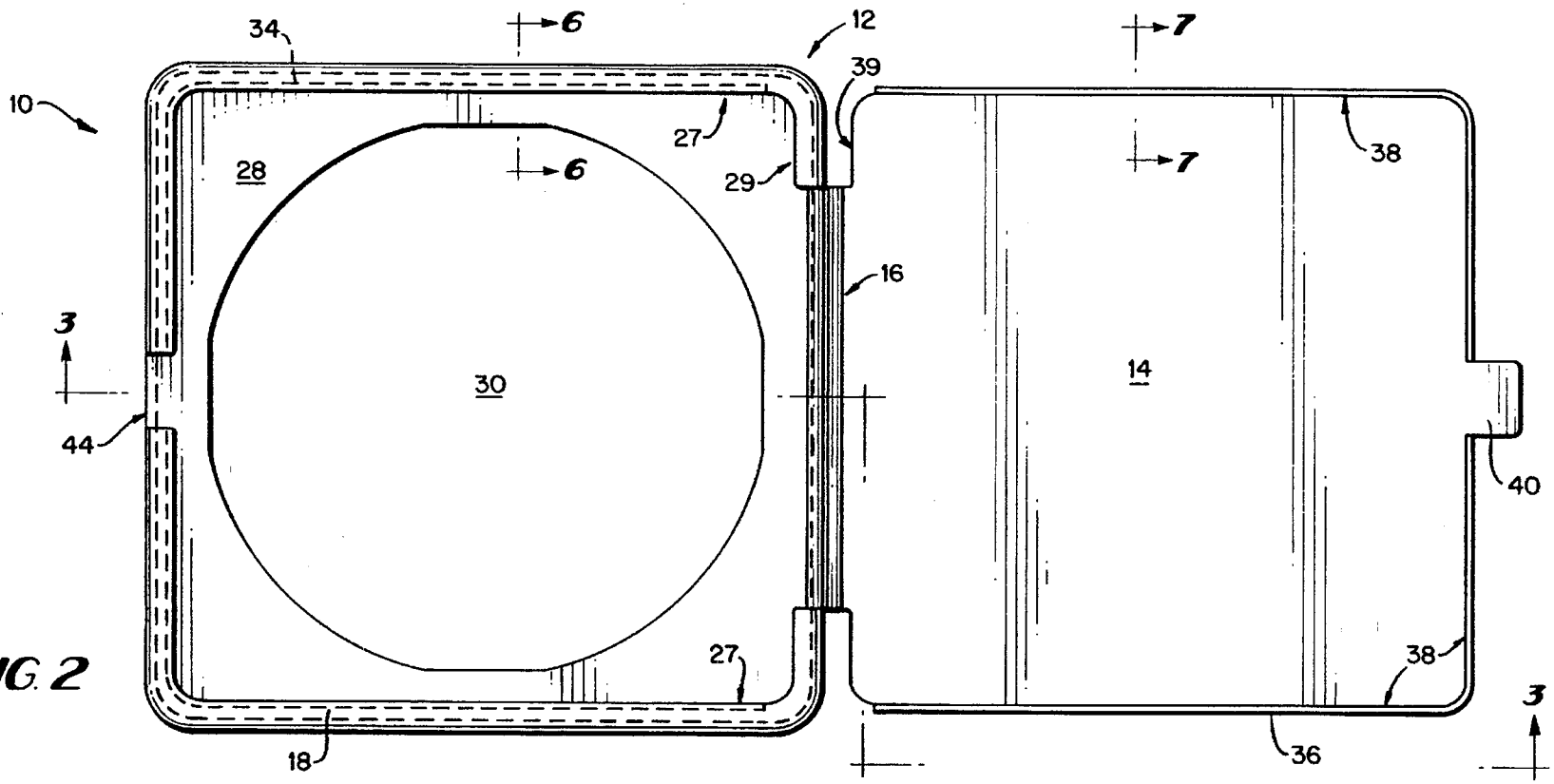
FIG. 2 is a top plan view of the device of the present invention shown in an open position.
Figure 3:
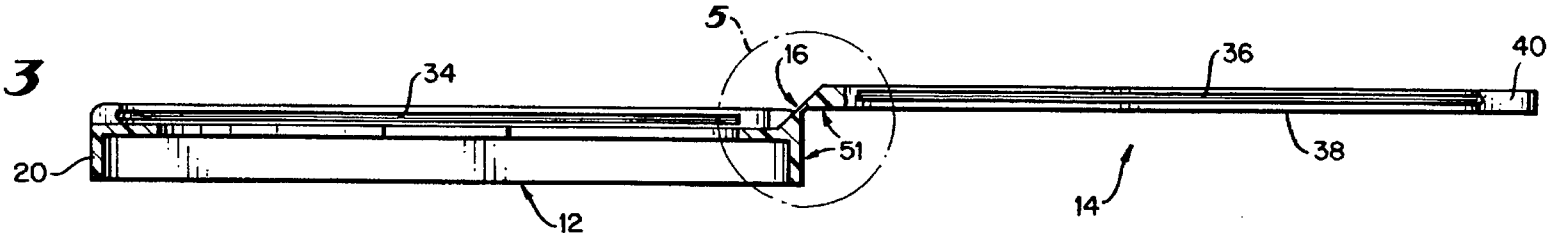
FIG. 3 is a side view of the device taken in partial cross-section along line 3—3 of FIG. 2.

As shown in FIGS. 1 through 3 and in FIG. 6, a groove 34 is horizontally disposed along the inner side walls 27 of the frame member 12. Preferably, the groove 34 does not extend along the inner back walls 29. As shown in FIGS. 1 through 3 and in FIG. 7, a resilient flanged sealing bead 36 extends around the outer peripheral edge 38 of the upper lid 14 and preferably does not extend along the back edge 39. As shown in FIGS. 1 and 7, the bead 36 is substantially perpendicular to the outer peripheral edge 38 of the lid 14. When the device is closed as shown in FIG. 4, the sealing bead 36 locks within the groove 34 to help provide an airtight seal.

The upper lid 14 is also provided with a pull tab 40 extending from its front side. The pull tab 40 fits within a slot 44 on the front edge of the frame member 12 when the lid is closed and enables the user to easily open the lid. To promote ease of operation, there is no bead along the pull tab 40 corresponding to the flanged bead 36 on the lid member outer edges 38 and there is no groove on the slot walls 45 of the frame member corresponding to the frame member groove 34.

The hinge member 16 is a one piece living hinge integrally formed with the frame and lid members which is capable of continual flexing without failure. This allows the device to be repeatedly opened and closed. As shown in FIGS. 1, 3, and 4, the hinge member 16 extends along the frame and lid member back edges 51 and connects an angled back wall portion 52 of the frame member 12 with an angled hinge wall portion 54 of the lid member 14. In one embodiment of the invention, the angled wall portions 52, 54 are centered and extend only partially along the lid and frame member back edges 51 so as to allow the inner back walls 29 to also extend along the frame back edge. As shown in detail in FIG. 5, the hinge member 16 is curved as at 50 to provide optimal flexibility and resiliency. In one embodiment, the curves 50 have a radius of 0.015 inches.

As shown in FIG. 5, angled back wall portion 52 extends from the recessed platform 28 at an angle A to the plane of the frame member 12. Also, angled hinge wall is formed at an angle B to the plane of the lid member 14. In one embodiment of the invention, angle A is slightly larger than angle B causing angled hinge wall portion 54 to mate slightly imperfectly with angled back wall portion 52 when the device is in the closed position. This allows sufficient clearance for the lid member as it is brought into the closed or locked position wherein the lid member bead 36 is locked in the frame member groove 34. This also prevents premature wear of the lid 14 and frame 12 members. In the embodiment of the invention as shown in FIG. 5, angled back wall portion 52 extends from the plane of the frame member 12 at an angle of about 50 degrees and angled hinge wall portion 54 extends at an angle of about 45 degrees from the plane of the lid member 14.

In closing the device, the lid member is first brought into position atop the frame member whereby the resilient flanged bead 36 rests atop the frame member edges 18. The lid member 14 may then be snapped shut within the frame member 12 by applying pressure in any direction along the edges 38, 39 of the lid member. In one embodiment of the invention, closure of the device is most easily initiated by applying pressure at the corners of the lid member. The applied pressure pushes the resilient flanged bead 36 past the frame member edges into locking arrangement with the frame member inner side wall groove 34 thereby positioning the lid member 14 in flush mating contact with the recessed platform 28. In one embodiment of the invention, the bead 36 has a slightly greater depth than the groove 34 so that, when the bead 36 is locked in the groove 34, pressure is created against the inner back wall 29 which has no bead and groove arrangement. This provides the device with a tighter seal which can withstand fluctuations in temperature so as to protect the rods inside the container.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A closure device for a container, comprising:

a rectangular frame member having an opening therein, said frame member also having a front edge, a back edge and two side edges, each of said edges having a top face and a substantially vertical inner face extending downwardly from the respective top face, and with a lower wall attached to and extending radially inwardly from said inner faces, said lower wall being spaced axially from said top faces, said frame member also having a groove horizontally disposed within the inner face of each of said side edges and front edge;

a rectangular lid member registrable within the inner faces of the edges of said frame member, said lid member having a top face and a bottom face, said lid member further having along the outer extremity thereof a front edge, a back edge and two side edges, wherein each of said edges of the lid member extends substantially vertically downward from said top face of the lid member, said lid member also having a resilient flanged sealing bead extending along the front and side edges substantially perpendicular to the front and side edges of the lid member; and a living hinge member integrally secured to said back edges of said frame and lid members such that when said lid member is positioned within said frame member, said lid member top face is flush with the top faces of said frame member edges and said flanged bead mates with said groove to thereby provide pressure against said hinge member so as to provide an air and moisture tight seal over said opening.

2. The device of claim 1 wherein said back edge of said frame and said back edge of lid each have an angled edge portion, and wherein said hinge member hinges said lid member to said frame member along said angled edge portions.

3. The device of claim 2 wherein said angled edge portions extend only partially along said lid and frame member back edges.

4. The device of claim 3 wherein said angled edge portions are centrally positioned about said lid and frame member back edges.

5. The device of claim 2 wherein said lid member angled edge portion extends from said lid member to said hinge member at an angle to the plane of the lid member and the frame member angled edge portion extends from the frame member to said hinge member at an angle to the plane of said frame member.

6. The device of claim 5 wherein said angle of said lid member angled edge portion is smaller than said angle of said frame member angled edge portion.

7. The device of claim 6 wherein said angle of said lid member angled edge portion is about 45 degrees and said angle of said frame member angled edge portion is about 50 degrees.

8. The device of claim 1 wherein said lid member further includes a tab member registrable within a tab slot within said frame member.

9. The device of claim 1 wherein the lower wall is in the form of a recessed platform which extends inwardly of the inner faces of the edges of said frame member.

10. The device of claim 9 wherein the platform lies directly under and in contact with the bottom face of the lid member when said lid member is positioned within said frame member.

* * * * *